US009458547B2

(12) United States Patent
Shen et al.

(10) Patent No.: US 9,458,547 B2
(45) Date of Patent: Oct. 4, 2016

(54) METHOD FOR ANODIZING AND DYEING METALLIC ARTICLE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Li-Ming Shen, Shenzhen (CN); Kai-Bo Cao, Shenzhen (CN); Zhi-Yong Fan, Shenzhen (CN); Wei-Chao Li, Shenzhen (CN); Jia-Xiong Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 817 days.

(21) Appl. No.: 13/847,047

(22) Filed: Mar. 19, 2013

(65) Prior Publication Data

US 2013/0248373 A1 Sep. 26, 2013

(30) Foreign Application Priority Data

Mar. 22, 2012 (CN) ..... 2012 1 0077777

(51) Int. Cl.

| | |
|---|---|
| ***C25D 11/02*** | (2006.01) |
| ***C25D 11/16*** | (2006.01) |
| ***C25D 11/24*** | (2006.01) |
| ***C25D 11/26*** | (2006.01) |
| ***C25D 11/30*** | (2006.01) |

(52) U.S. Cl.

CPC ..... *C25D 11/02* (2013.01); *C25D 11/022* (2013.01); *C25D 11/024* (2013.01); *C25D 11/16* (2013.01); *C25D 11/243* (2013.01); *C25D 11/246* (2013.01); *C25D 11/26* (2013.01); *C25D 11/30* (2013.01)

(58) Field of Classification Search

CPC ..... C25D 11/02
USPC ..... 205/95
See application file for complete search history.

(56) References Cited

U.S. PATENT DOCUMENTS

| | | | | |
|---|---|---|---|---|
| 6,322,689 | B1 * | 11/2001 | Omasa | C25D 11/02 204/222 |
| 6,358,566 | B1 * | 3/2002 | Rosenfeld | B44F 1/08 205/151 |
| 2014/0001052 | A1 * | 1/2014 | Maloney | C25D 11/243 205/196 |

FOREIGN PATENT DOCUMENTS

| | | | |
|---|---|---|---|
| CN | 1421548 A | | 6/2003 |
| CN | 1163639 C | | 8/2004 |
| CN | 1920111 A | | 2/2007 |
| CN | 201292415 Y | * | 8/2009 |
| TW | 201011127 A | | 3/2010 |

OTHER PUBLICATIONS

Machine Translation of CN201292415Y.*
Huang-Min Chen; Fabrication of nanoporous anodic alumina templates and the optical property of imprinted nanostructures; Department of Materials Science and Engineering National Cheng Kung University; Jul. 7, 2009; p. 34 paragraph 2.

* cited by examiner

*Primary Examiner* — Bryan D. Ripa
(74) *Attorney, Agent, or Firm* — Zhigang Ma

(57) ABSTRACT

A method for anodizing and dyeing a metallic article including a first dipped end, a second dipped end opposite to the first dipped end, and a decorated surface located between the first dipped end and the second dipped end, includes steps as follows: anodizing the metallic article to form an anodization layer on the decorated surface by an anodizing treatment, in which the anodization layer is porous with a number of holes, an immersion time of the decorated surface immersed in the electrolyte solution changes gradually from the first dipped end toward the second dipped end, and a depth of the plurality of holes of the anodization layer after the anodizing step thereby changes gradually from the first dipped end toward the second dipped end; and coloring the metallic article sealed in a dyeing treatment.

17 Claims, 7 Drawing Sheets

METHOD FOR ANODIZING AND DYEING METALLIC ARTICLE

BACKGROUND

1. Technical Field

The present disclosure generally relates to methods for anodizing and dyeing metallic articles.

2. Description of Related Art

Metallic articles, such as articles made of aluminum/aluminum alloy, magnesium/magnesium alloy, and titanium/titanium alloy, are often anodized for protection, and then dyed or painted for achieving surface appearance requirements. However, this method is able to only provide an uniform singular monochromic color scheme and appearance.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present disclosure. Moreover, in the drawings like reference numerals designate corresponding parts throughout the several views. Wherever possible, the same reference numerals are used throughout the drawings to refer to the same or like elements of an embodiment.

DETAILED DESCRIPTION

Figure 1:
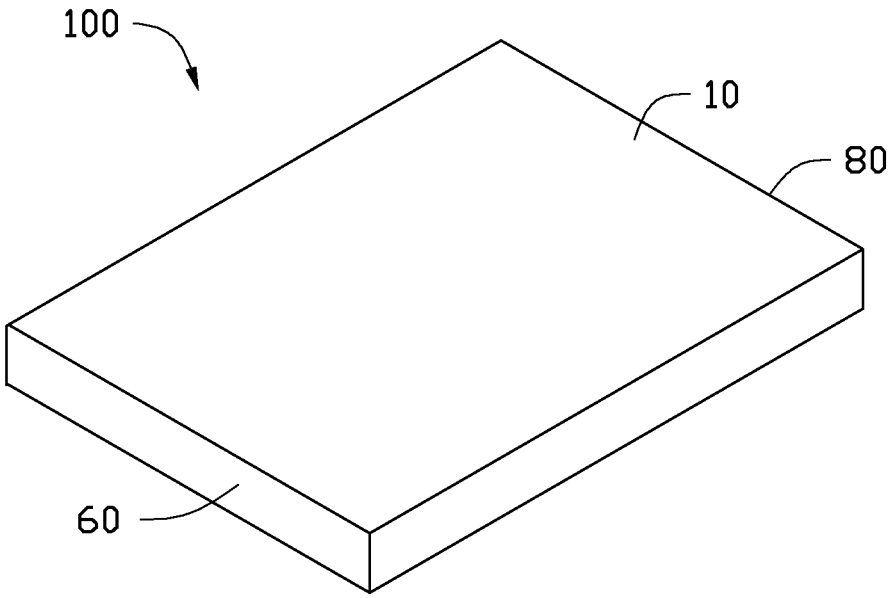
FIG. 1 shows an isometric view of a workpiece to be anodized and dyed of a first or second embodiment.

FIG. 1 shows a workpiece 100 according to an illustrated embodiment to be anodized and dyed by a method for anodizing and dyeing a metallic article. In the illustrated embodiment, the workpiece 100 is a metallic article made of aluminum alloy, and is substantially rectangular plate-like in shape. The workpiece 100 includes a first dipped end 60, a second dipped end 80 opposite to the first dipped end 60, and a decorated surface 10 located between the first dipped end 60 and the second dipped end 80. The decorated surface 10 of the workpiece 100 is to be dyed. In other embodiments, the workpiece 100 can be made of aluminum, magnesium, magnesium alloy, titanium, or titanium alloy.

Figure 6:
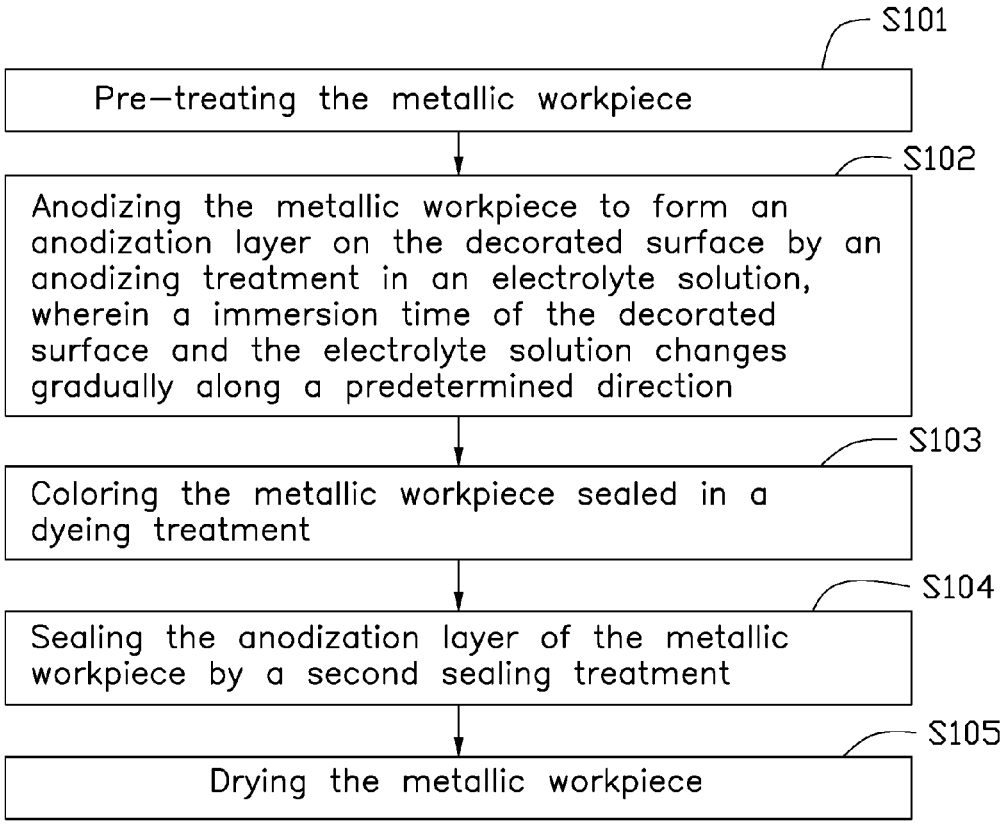
FIG. 6 is a flowchart showing a first embodiment of a method for anodizing and dyeing the workpiece of FIG. 1.

Referring also to FIG. 6, a first embodiment of a method for anodizing and dyeing the workpiece 100 of the illustrated embodiment of FIG. 1 is described as follows.

In step S101, the workpiece 100 is subjected to one or more pre-anodizing treatments, for smoothing and texturing the decorated surface 10, and removing grease residues or a native oxide layer from the decorated surface 10. The one or more pre-anodizing treatments may include one or more of polishing, texturing, degreasing, alkaline etching, and desmutting. Degreasing is performed using a weak alkaline solution, such as sodium pyrophosphate solution. Alkaline etching is performed using a strong alkaline solution, such as a sodium hydroxide solution. Desmutting is performed using a strong acid solution. Examples of polishing methods that may be used include chemical polishing or mechanical polishing. Examples of texturing that may be used include sandblasting or wiredrawing.

In step S102, the workpiece 100 is anodized in an electrolyte solution 200, such that an anodization layer 20 is formed on the decorated surface 10. The anodization layer 20 is porous by having a plurality of holes 30 therein. During the anodizing treatment, an immersion time of the decorated surface 10 in the electrolyte solution is varied gradually along a predetermined direction, such that the depth of the holes 30 gradually changes along the predetermined direction (referring to FIG. 3). The anodizing treatment may be a direct current anodizing treatment, an alternating current anodizing treatment, or a pulse current anodizing treatment. In an illustrated embodiment, the direct current anodizing treatment is applied to the workpiece 100. The workpiece 100 as an anode is electrically-connected to a positive electrode, and a sulfuric acid solution is used as the electrolyte solution 200, such that the anodization layer 20 is formed on the decorated surface 10. A thickness of the anodization layer 20 and a depth of the holes 30 can be changed by varying the amounts of anodization time (duration), current applied, and/or voltage applied. In other embodiments, the electrolyte solution may include nitrate ion, phosphate ion, chromate ion, or silicate ion.

Figure 2:
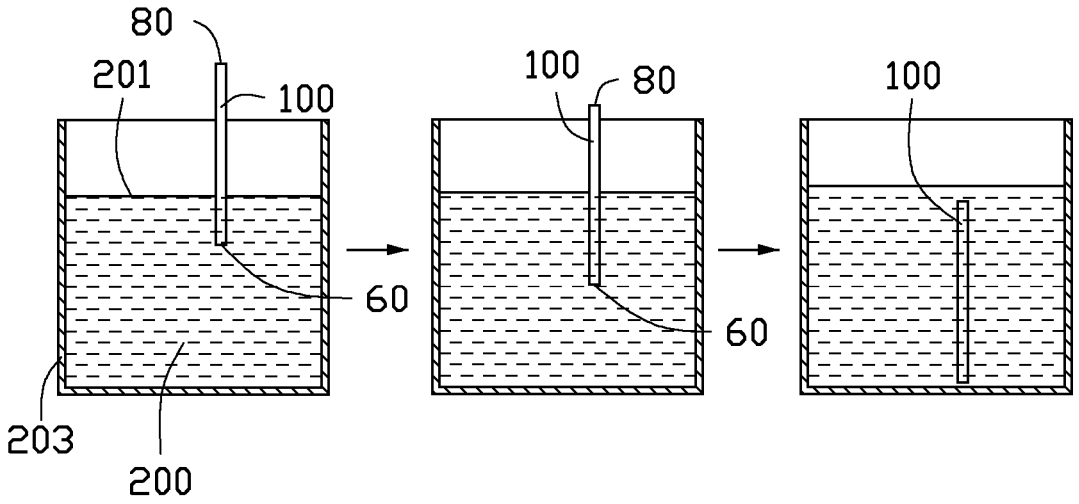
FIG. 2 shows an anodizing treatment step for the workpiece of FIG. 1.
Figure 3:
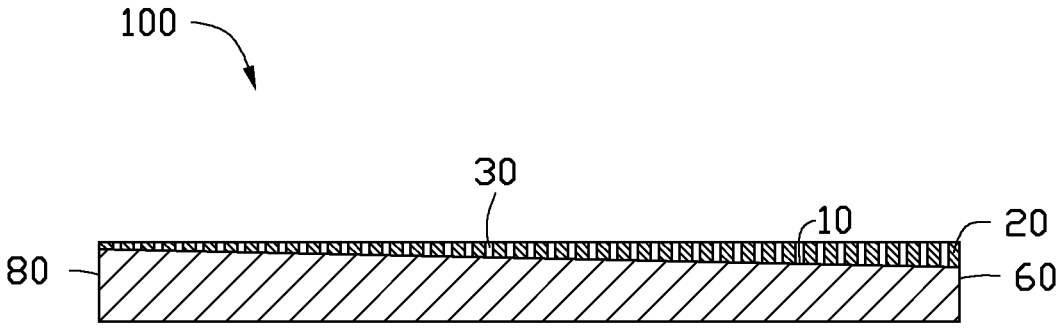
FIG. 3 shows a cross-sectional view of the workpiece of FIG. 1 after the anodizing treatment step.
Figure 4:
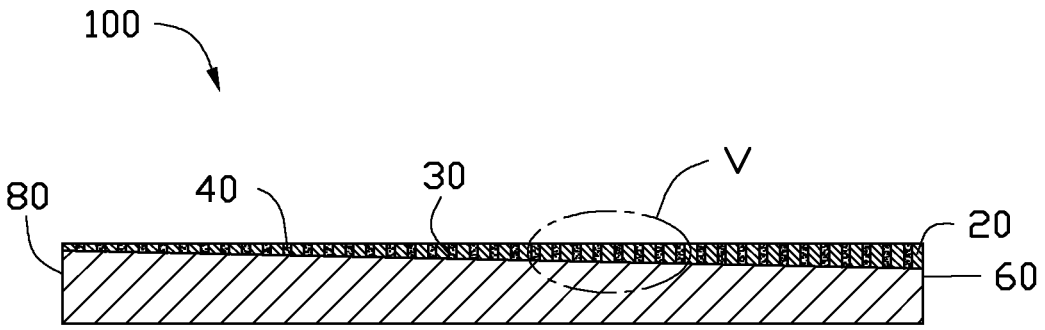
FIG. 4 shows a cross-sectional view of the workpiece of FIG. 1 after a sealing treatment step.
Figure 5:
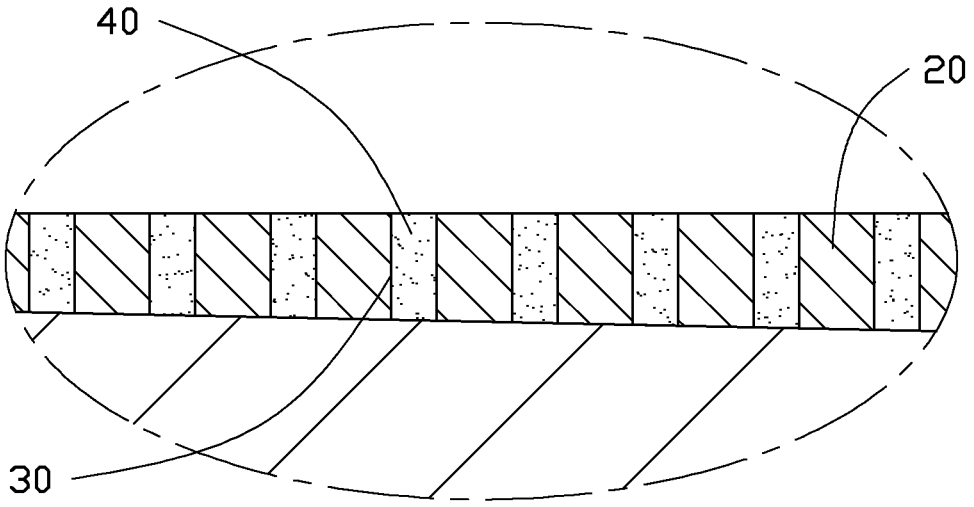
FIG. 5 shows an enlarged view of a circled portion V in FIG. 4.

In the illustrated embodiment, referring to FIGS. 2 and 3, the decorated surface 10 is configured substantially perpendicular to a liquid level 201 of the electrolyte solution 200 in a container 203, and the workpiece 100 is immersed in the electrolyte solution 200 at a predetermined velocity by a driving mechanism (not shown), and then taken out from the electrolyte solution 200 by the driving mechanism. Because the first dipped end 60 of the workpiece 100 enters the electrolyte solution 200 first and exits last, the anodization layer 20 will be thickest at the first dipped end 60 and gradually thinning toward the second dipped end 80, with the result being that the depth of each of the holes 30 gradually increases going from the second dipped end 80 toward the first dipped end 60 of the workpiece 100. The predetermined velocity of the workpiece 100 immersed in the electrolyte solution 200 can be maintained to be constant or varying. When the predetermined velocity of immersion of the workpiece 100 is kept or maintained constant, the depth of the holes 30 increases uniformly. On the other hand, if the predetermined velocity of immersion of the workpiece 100 changes or varies, the depth of the holes 30 increases non-uniformly.

In step S103, the workpiece 100 is colored by a dyeing treatment. In the dyeing treatment step, a coloring agent 40 enters and fills the holes 30, respectively, to dye the decorated surface 10. Because the depth of the holes 30 gradually changes, an amount of the coloring agent 40 that can be contained in the holes 30 thereby varies. Thus, the color of the coloring agent 40 filled in the holes 30 of the workpiece 100 appears in different shades (without noticeable color difference found in between adjacent regions of differing shades) by possessing a continuous color gradient, and the anodization layer 20 is colored with a gradual changing color or color gradient.

In step S104, the workpiece 100 is subjected to a sealing treatment. In the sealing treatment step, the workpiece 100 is immersed in a sealing solution to seal the holes 30, such that the anodization layer 20 has good or sufficient wear resistance. Sealing agents 40 in the sealing solution 200 can be nickel acetate, nickel sulfate, or cobalt sulfate.

In step S105, the workpiece 100 is heat dried.

In other embodiments, if the workpiece 100 is cleaned or a texturing effect is not needed, step S101 can be omitted. Step S104 can be omitted if a required wear resistance of the workpiece is low. Step S105 can be omitted if desired, and the workpiece can be air dried instead.

Because the decorated surface 10 is not immersed in the electrolyte solution all at once, the depths of the holes 30 after the anodization treatment changes gradually from the first dipped end 60 toward the second dipped end 80 for each workpiece 100, and the amount of the coloring agent 40 received in the holes 30 during the dyeing treatment varies gradually from the first dipped end 60 toward the second dipped end 80. Thus, the color of the coloring agent 40 appears in different shades on the decorated surface 10 without noticeable color difference found in between adjacent portions, and the anodization layer 20 is colored with a gradual changing color or continuous color gradient. The above-described method for anodizing and dyeing a metallic article is easy to control, and thus is suitable for mass production.

Figure 7:
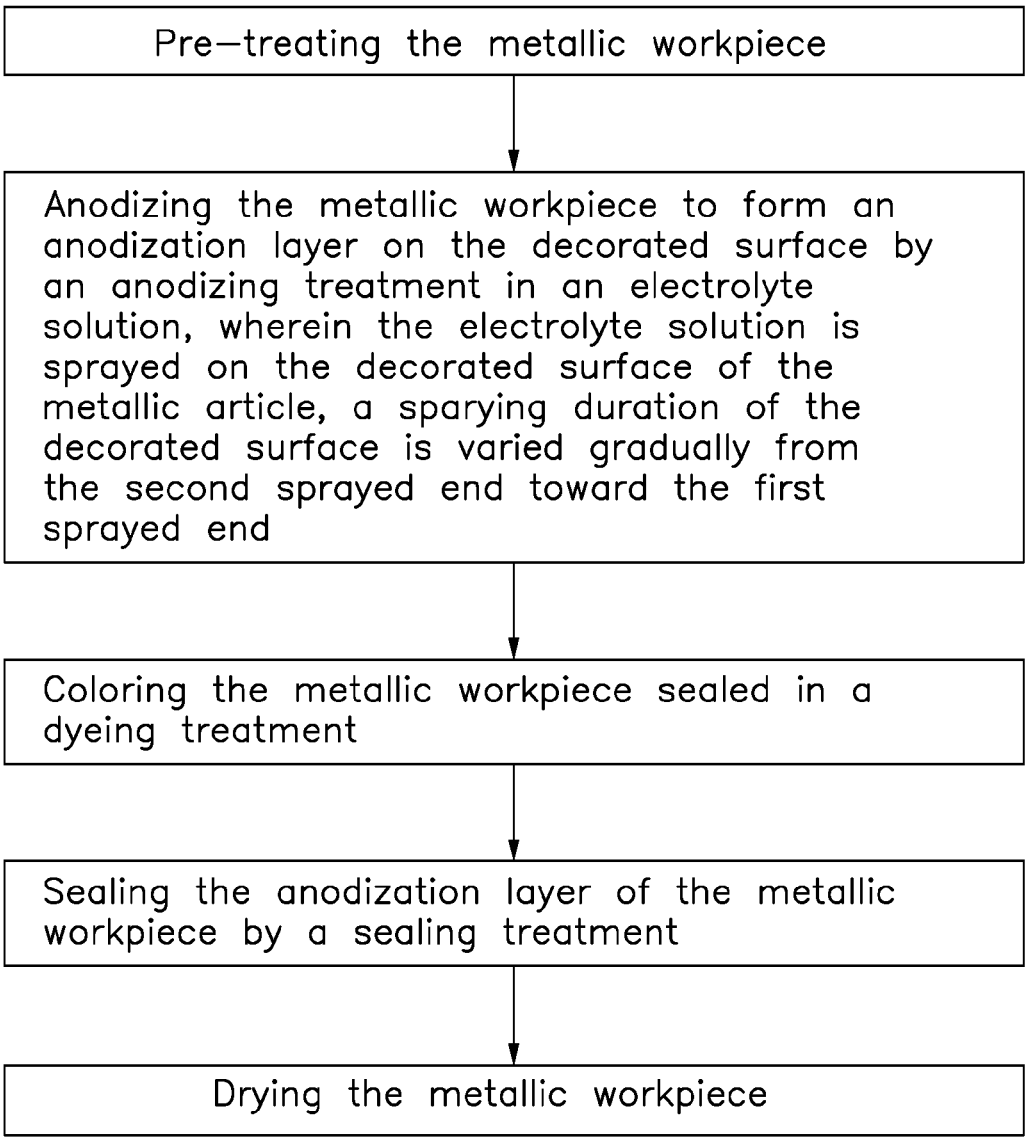
FIG. 7 is a flowchart showing a second embodiment of a method for anodizing and dyeing the workpiece of FIG. 1.

In other embodiments, after pre-anodizing treatments, the decorated surface 10 may be anodized in the electrolyte solution 200 in other ways or via other techniques. For example, in a second embodiment (referring to FIG. 7), the electrolyte solution 200 can be sprayed on the decorated surface 10 by a sprayer connected to the electrolyte solution 200, and a spraying duration is controlled along a predetermined direction such as from a first sprayed end to a second sprayed end. Then, the workpiece 100 is colored by a dyeing treatment, sealed by a sealing treatment, and heat dried.

Depending on the embodiment, some of the steps being described may be removed or eliminated, while other steps may be added, and the sequence of steps may be changed. It is also to be understood that the description and the claims drawn to a method may include some indication in reference to certain steps. However, the indication used is only to be viewed for identification purposes and not as a suggestion as to an order for the steps.

It is to be understood, however, that even through numerous characteristics and advantages of the disclosure have been set forth in the foregoing description, together with details of the structure and function of the present disclosure, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A method for anodizing and dyeing a metallic article, the metallic article comprises a first dipped end, a second dipped end opposite to the first dipped end, and a decorated surface between the first dipped end and the second dipped end, the decorated surface of the metallic article being dyed, the method comprising steps as follows:

anodizing the metallic article to form an anodization layer on the decorated surface thereof by an anodizing treatment in an electrolyte solution, wherein the anodization layer is porous by having a plurality of holes therein, an immersion time of the decorated surface immersed in the electrolyte solution is varied gradually along a predetermined direction, and a depth of the plurality of holes of the anodization layer after the anodizing step thereby changes gradually along the predetermined direction; and coloring the metallic article in a dyeing treatment; wherein a coloring agent enters and fills the plurality of holes, thereby an amount of the coloring agent contained in the holes varies.

2. The method for anodizing and dyeing a metallic article of claim 1, wherein in the anodizing step, the first dipped end of the metallic article enters in the electrolyte solution first and exits last when the metallic article is immersed in the electrolyte solution, such that the depth of the plurality of holes of the anodization layer increases gradually from the second dipped end toward the first dipped end of the metallic article.

3. The method for anodizing and dyeing a metallic article of claim 2, wherein a predetermined velocity of the metallic article immersing in the electrolyte solution is constant.

4. The method for anodizing and dyeing a metallic article of claim 1, wherein the method further comprises a step of pre-treating the metallic article by a pre-anodizing treatment before the anodizing step.

5. The method for anodizing and dyeing a metallic article of claim 4, wherein the pre-anodizing treatment comprises a polishing, texturing, degreasing, alkaline etching, or desmutting.

6. The method for anodizing and dyeing a metallic article of claim 1, wherein the method further comprises a step of sealing the metallic article by a sealing treatment after the step of coloring the metallic article to seal the plurality of holes after the metallic article has been dyed.

7. The method for anodizing and dyeing a metallic article of claim 1, wherein the metallic article is made of aluminum, aluminum alloy, magnesium, magnesium alloy, titanium, or titanium alloy.

8. The method for anodizing and dyeing a metallic article of claim 1, wherein the anodizing treatment comprises a direct current anodizing treatment, an alternating current anodizing treatment, or a pulse current anodizing treatment.

9. The method for anodizing and dyeing a metallic article of claim 6, wherein sealing agents of the sealing solution comprise nickel acetate, nickel sulfate, or cobalt sulfate.

10. A method for anodizing and dyeing a metallic article, the metallic article comprises a first dipped end, a second dipped end opposite to the first dipped end, and a decorated surface located between the first dipped end and the second dipped end, the decorated surface of the metallic article being dyed, the method comprising steps as follows:

anodizing the metallic article to form an anodization layer on the decorated surface by an anodizing treatment, wherein the anodization layer is porous by having a plurality of holes therein, the first dipped end of the metallic article enters in the electrolyte solution first and exits last when the metallic article is immersed in the electrolyte solution, such that the depth of the plurality of holes of the anodization layer increases gradually from the second dipped end toward the first dipped end; and coloring the metallic article in a dyeing treatment; wherein a coloring agent enters and fills the plurality of holes, thereby an amount of the coloring agent contained in the holes varies.

11. The method for anodizing and dyeing a metallic article of claim 10, wherein a predetermined velocity of the metallic article immersing in the electrolyte solution is constant.

12. The method for anodizing and dyeing a metallic article of claim 11, wherein the method further comprises a step of pre-treating the metallic article by a pre-anodizing treatment before the step of anodizing the metallic article.

13. The method for anodizing and dyeing a metallic article of claim 12, wherein the pre-anodizing treatment comprises a polishing, texturing, degreasing, alkaline etching, or desmutting.

14. The method for anodizing and dyeing a metallic article of claim 11, wherein the method further comprises a step of sealing the metallic article by a sealing treatment after the step of coloring the metallic article to seal the plurality of holes after the metallic article has been dyed.

15. The method for anodizing and dyeing a metallic article of claim 11, wherein the metallic article is made of aluminum, aluminum alloy, magnesium, magnesium alloy, titanium, or titanium alloy.

16. The method for anodizing and dyeing a metallic article of claim 11, wherein the anodizing treatment comprises a direct current anodizing treatment, an alternating current anodizing treatment, or a pulse current anodizing treatment.

17. A method for anodizing and dyeing a metallic article, the metallic article comprises a first sprayed end, a second sprayed end opposite to the first sprayed end, and a decorated surface between the first sprayed end and the second sprayed end, the decorated surface of the metallic article being dyed, the method comprising steps as follows:

anodizing the metallic article to form an anodization layer on the decorated surface thereof by an anodizing treatment in an electrolyte solution, wherein the anodization layer is porous by having a plurality of holes therein, the electrolyte solution is sprayed on the decorated surface of the metallic article, a spraying duration of the decorated surface is varied gradually from the second sprayed end toward the first sprayed end; and coloring the metallic article in a dyeing treatment; wherein a coloring agent enters and fills the plurality of holes, thereby an amount of the coloring agent contained in the holes varies.

* * * * *